US009670427B2

(12) United States Patent
Kulprathipanja et al.

(10) Patent No.: US 9,670,427 B2
(45) Date of Patent: Jun. 6, 2017

(54) METHODS AND APPARATUSES FOR PRODUCING HYDROCARBONS

(71) Applicant: UOP LLC, Des Plaines, IL (US)

(72) Inventors: Sathit Kulprathipanja, Shaumburg, IL (US); Christopher McCormick, Surrey (GB); Joseph M. Ritchie, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 378 days.

(21) Appl. No.: 14/546,239

(22) Filed: Nov. 18, 2014

(65) Prior Publication Data

US 2016/0137932 A1 May 19, 2016

(51) Int. Cl.

| | |
|---|---|
| ***C10G 69/04*** | (2006.01) |
| ***C10G 55/06*** | (2006.01) |
| ***C10G 45/00*** | (2006.01) |
| ***C10G 47/00*** | (2006.01) |
| ***C10G 11/18*** | (2006.01) |

(52) U.S. Cl.
CPC ..... *C10G 69/04* (2013.01); *C10G 11/18* (2013.01); *C10G 45/00* (2013.01); *C10G 47/00* (2013.01); *C10G 2300/207* (2013.01)

(58) Field of Classification Search
CPC ..... C10G 55/06; C10G 69/04
See application file for complete search history.

(56) References Cited

U.S. PATENT DOCUMENTS

| | | | | |
|---|---|---|---|---|
| 4,209,383 | A * | 6/1980 | Herout | C10L 1/06 208/93 |
| 4,899,015 | A | 2/1990 | Harandi et al. | |
| 6,576,805 | B2 | 6/2003 | Keady et al. | |
| 8,256,243 | B2 | 9/2012 | Verma | |

* cited by examiner

*Primary Examiner* — Randy Boyer

(57) ABSTRACT

Methods and oil refinery apparatuses are provided for producing hydrocarbons. A method includes fractionating a crude oil feedstock to produce a crude saturated stream and a residual stream. The residual stream is cracked in a cracking device to produce an unsaturated stream, and the unsaturated stream and the crude saturated stream are combined to produce a combined stream. The combined stream is fractionated to produce a refinery fuel gas stream.

20 Claims, 1 Drawing Sheet

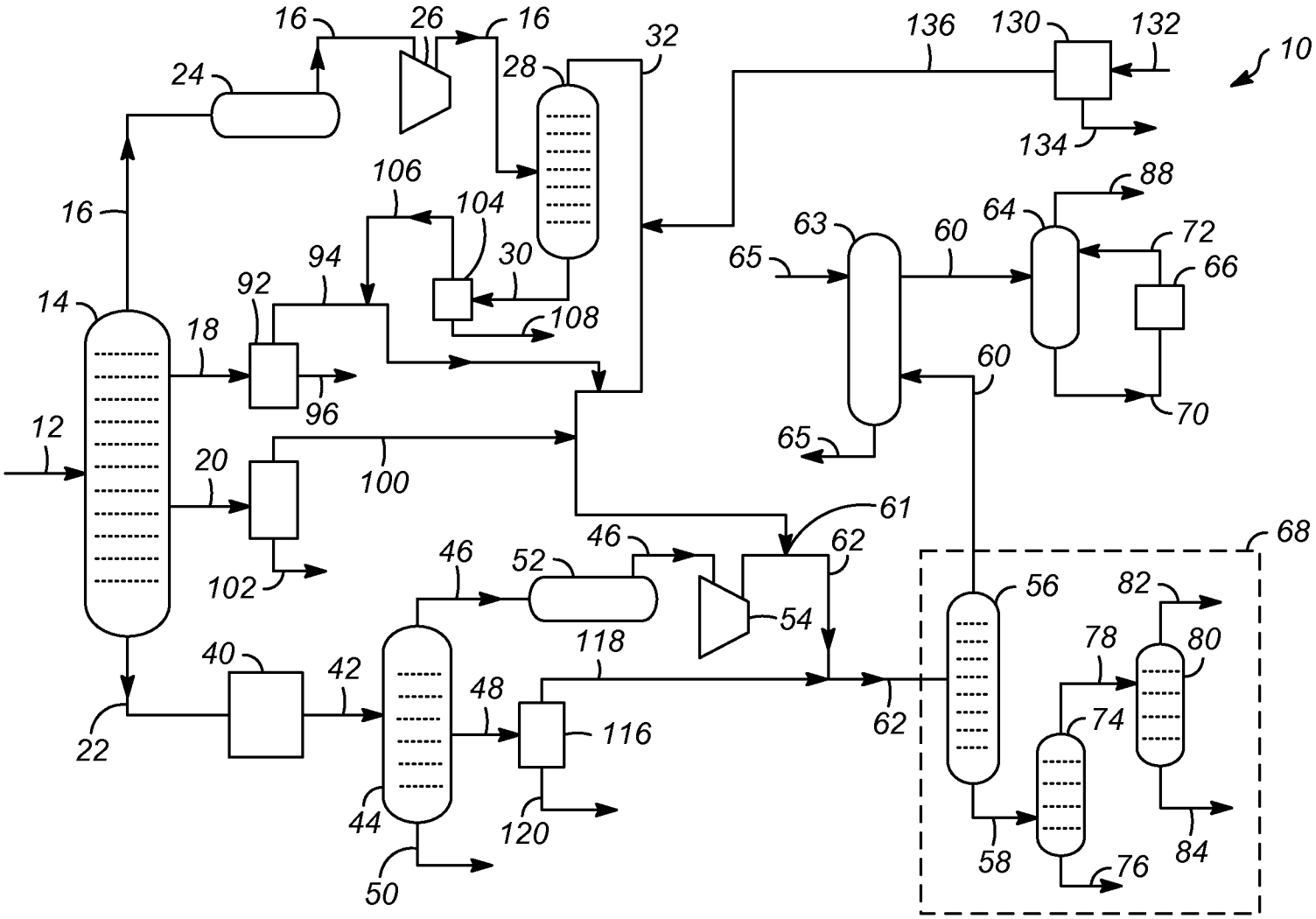
10
12
14
16
18
20
22
24
26
28
30
32
40
42
44
46
48
50
52
54
56
58
60
61
62
63
64
65
66
68
70
72
74
76
78
80
82
84
88
92
94
96
100
102
104
106
108
116
118
120
130
132
134
136

METHODS AND APPARATUSES FOR PRODUCING HYDROCARBONS

TECHNICAL FIELD

The present disclosure generally relates to methods and apparatuses for producing hydrocarbons, and more particularly relates to methods and apparatuses for producing hydrocarbons with limited refinery equipment to reduce cost.

BACKGROUND

Crude oil is produced and processed in oil refineries all over the world. Crude oil includes a mixture of hydrocarbons with a wide variety of molecular weights, sulfur compounds, nitrogen compounds, and other compounds. Oil refining apparatuses separate the different compounds to produce various products, and many of these products are further processed. For example, sulfur compounds may be removed and hydrocarbons that boil within a prescribed range may be isolated for use as fuel. Specific hydrocarbons, such as para-xylene, may be produced and/or separated. Some process streams are further processed to produce compounds with a higher value or more demand, such as the cracking of heavy oils to produce diesel fuels or gasoline with high cetane or octane ratings, respectively. The refining of crude oil is an important component of the world economy.

Oil refining apparatuses typically include many different process units connected together, where the process units may be sized for large scale production. As such, oil refining apparatuses are expensive to build and operate. The cost to build and operate an oil refining apparatus can be prohibitive. Therefore, there is a need for oil refinery configurations that reduce the equipment count and thereby reduce the installation and operating costs of oil refinery apparatuses.

Accordingly, it is desirable to develop methods and oil refining apparatuses for producing hydrocarbons from crude oil that co-process similar streams. In addition, it is desirable to develop methods and oil refining apparatuses for producing hydrocarbons with reduced equipment counts over traditional oil refinery configurations. Furthermore, other desirable features and characteristics of the present embodiment will become apparent from the subsequent detailed description and the appended claims, taken in conjunction with the accompanying drawings and this background.

BRIEF SUMMARY

Oil refining apparatuses and methods of producing hydrocarbons are provided. In an exemplary embodiment, a method includes fractionating a crude oil feedstock to produce a crude saturated stream and a residual stream. The residual stream is cracked in a cracking device to produce an unsaturated stream, and the unsaturated stream and the crude saturated stream are combined to produce a combined stream. The combined stream is fractionated to produce a refinery fuel gas stream.

In accordance with another exemplary embodiment, a method for producing hydrocarbons includes hydrocracking a hydrocracker feedstock to produce a hydrocracker saturated stream and a hydrocracker product stream. A residual stream is cracked in a cracking device to produce an unsaturated stream. The hydrocracker saturated stream and the unsaturated stream are combined to produce a combined stream, and the combined stream is fractionated to produce a gasoline stream.

In accordance with a further exemplary embodiment, an oil refining apparatus includes a crude distillation unit with a crude receiver. A saturated compressor is fluidly coupled to the crude receiver, and a fluid catalytic cracking unit is fluidly coupled to the crude distillation unit. A fluid catalytic cracking compressor is fluidly coupled to the fluid catalytic cracking unit, and a union is coupled to the fluid catalytic cracking compressor and the saturated compressor. A fractionation area is fluidly coupled to the union.

BRIEF DESCRIPTION OF THE DRAWINGS

Various embodiments will hereinafter be described in conjunction with the FIGURE, which is a schematic diagram of an oil refining apparatus and methods for producing hydrocarbons using the oil refining apparatus, in accordance with an exemplary embodiment, wherein like numerals denote like elements.

DETAILED DESCRIPTION

The following detailed description is merely exemplary in nature and is not intended to limit the application and uses of the embodiment described. Furthermore, there is no intention to be bound by any theory presented in the preceding background or the following detailed description.

In accordance with various exemplary embodiments described herein, an oil refining apparatus includes a crude distillation unit that produces a saturated stream, where the saturated stream is primarily paraffinic compounds. An unsaturated stream may be produced by a cracking device, such as a fluid catalytic cracker or a thermal cracking unit such as a coker. The saturated stream and the unsaturated stream are combined and co-processed to reduce the equipment count necessary in the oil refining apparatus.

Referring to the exemplary embodiment of an oil refining apparatus 10 illustrated in FIG. 1, a crude oil supply 12 is introduced to a crude distillation unit 14. The crude oil supply 12 includes a mixture of many hydrocarbons, and may include sulfur compounds such as mercaptans and sulfides. The crude oil supply 12 may also include nitrogen compounds. In this description, the hydrocarbons are referred to by the letter "C" followed by a number or range of numbers, where the letter "C" denotes carbon, and the number or range of numbers denotes the number of carbon atoms in a molecule. For example, a C5 hydrocarbon has 5 carbons, and a $C5^-$ stream includes hydrocarbons with 5 or fewer carbon atoms. The crude oil supply 12 includes $C5^-$ compounds that are primarily saturated paraffins, with very few if any olefins in the $C5^-$ range. For example, the $C5^-$ range of hydrocarbons in the crude oil supply 12 may be about 1 weight percent or less olefins.

The crude distillation unit 14 fractionates the crude oil supply 12 to produce a plurality of streams differentiated by boiling point, where the "lighter" compounds have a lower boiling point and the "heavier" compounds have a higher boiling point. In an exemplary embodiment, the crude oil supply 12 is fractionated in the crude distillation unit 14 to produce a crude saturated stream 16, a crude kerosene stream 18, a crude diesel stream 20, and a residual stream 22. The crude distillation unit 14 may produce other hydrocarbons streams in other embodiments, such as a liquid petroleum gas (LPG), jet fuel, and heavy gas oil (not illustrated). The crude distillation unit 14 may include one or more fractionation columns in various embodiments. For example, the crude distillation unit 14 may include a vacuum tower in some embodiments (not illustrated), as further described below. In an exemplary embodiment, the crude distillation unit 14 operates at conditions to provide separation of naphtha and kerosene. In some embodiments, the crude saturated stream 16 primarily includes $C10^-$ compounds and has an atmospheric boiling range of about −160° C. to about 170° C. The crude kerosene stream 18 may have an atmospheric boiling range of about 170° C. to about 240° C., the crude diesel stream 20 may have an atmospheric boiling range of about 240° C. to about 350° C., and the residual stream 22 may have a boiling range of from about 350° C. and higher. In embodiments with a vacuum tower (not illustrated), the residual stream 22 may have a boiling range of from about 560° C. and higher. Some compounds in the residual stream 22 may decompose before boiling, so the upper limit of the boiling range may not be clearly defined.

The crude saturated stream 16 is collected from the crude distillation unit 14 in a crude receiver 24. In this description, process equipment is fluidly coupled together when fluids from one piece of equipment flow to another. The crude saturated stream 16 flows from the crude receiver 24 to a saturated compressor 26, where the pressure of the crude saturated stream 16 is increased to nominally liquefy material with a boiling point equal to or higher than propane. After the saturated compressor 26, the crude saturated stream 16 may be fractionated in a naphtha stabilizer 28 to produce a saturated naphtha stream 30 and a saturated stabilizer stream 32. The naphtha stabilizer 28 is operated at appropriate conditions to separate $C5^+$ paraffinic hydrocarbons from $C4^-$ paraffinic hydrocarbons, as understood by those skilled in the art. The saturated naphtha stream 30 primarily includes C5+ compounds as determined by the composition of the crude saturated stream 16. The saturated stabilizer stream 32 primarily includes $C4^-$ compounds, and may include hydrogen sulfide or other sulfur compounds as well as nitrogen compounds.

An unsaturated stream may be formed from a variety of operating units. For example, various cracking devices that "crack" given hydrocarbons into smaller, more volatile hydrocarbons produce olefins. An unsaturated stream typically includes olefins, and various cracking devices or other operating units can be used to produce unsaturated streams. In an exemplary embodiment, the cracking device may be a fluid catalytic cracking unit (FCC unit) 40, as described below, but other cracking devices may be used in place of, or in addition to, an FCC unit 40 in various embodiments. For example, a coker (not illustrated) is another cracking device that can produce an unsaturated stream, so a coker may be used in place of, or in addition to, an FCC unit 40 to produce an unsaturated stream. An FCC unit 40 is illustrated and described as the cracking device in this description for simplicity and clarity, but other cracking devices or other unsaturated stream sources may be used in place of, or in addition to, an FCC unit 40 in various embodiments.

Referring back to the crude distillation unit 14, the residual stream 22 includes high boiling "heavy" compounds. For example, the residual stream 22 may primarily include $C20^+$ compounds, with about 10 weight percent or less of $C19^-$ compounds. These high boiling, heavy compounds are introduced to an FCC unit 40 to produce an FCC effluent stream 42. In the FCC unit 40, the hydrocarbons in the residual stream 22 are contacted with a cracking catalyst at cracking conditions, and the hydrocarbons are "cracked" or broken down into smaller hydrocarbons with lower boiling points. In an exemplary embodiment, the cracking catalyst includes a high activity crystalline alumina silicate and/or zeolite, which are dispersed in a porous inorganic carrier material such as silica, aluminum, zirconium, or clay. An exemplary embodiment of a catalyst includes crystalline zeolite as the primary active component, a matrix, a binder, and a filler. The zeolite ranges from about 10 to about 50 weight percent of the catalyst, and is a silica and alumina tetrahedral with a lattice structure that limits the size range of hydrocarbon molecules that can enter the lattice. The matrix component includes amorphous alumina, and the binder and filler provide physical strength and integrity. Silica sol or alumina sol are used as the binder and kaolin clay is used as the filler. It will be appreciated, however, that other suitable catalysts can be used in the FCC unit 40. The cracking conditions may include a temperature of from about 480° C. to about 570° C. and a pressure of from about 100 kilo Pascals gauge (kPa) to about 250 kPa. The FCC unit 40 may produce a wide variety of hydrocarbons, and hydrocarbons from the FCC unit 40 typically include higher concentrations of olefins than in the crude oil supply 12.

The FCC effluent stream 42 is introduced into an FCC fractionation unit 44, where the various hydrocarbons are separated based on boiling point. Several streams may be produced by the FCC fractionation unit 44, such as an unsaturated stream 46, an FCC diesel stream 48, and an FCC heavy cycle oil 50. The FCC fractionation unit 44 may produce several other streams in various embodiments, as described for the crude distillation unit 14 described above. The FCC fractionation unit 44 may include one or more fractionation columns in various embodiments, and is operated at suitable conditions to separate the various fractions as is understood by those skilled in the art. In an exemplary embodiment, the unsaturated stream 46 primarily includes $C10^-$ compounds, so the unsaturated stream 46 includes naphtha compounds as well as lighter compounds. The unsaturated stream 46 may include about 10 to about 70 weight percent of olefins in some embodiments, and generally has a higher concentration of olefins than the crude saturated stream 16.

In an exemplary embodiment, the unsaturated stream 46 is collected in an FCC receiver 52, and then pressurized in an FCC compressor 54. The FCC compressor 54 pressurizes the unsaturated stream 46 to nominally liquefy the $C3^+$ compounds. The saturated stabilizer stream 32 is combined with the unsaturated stream 46 in a union 61 to produce a combined stream 62 in an exemplary embodiment. The combined stream 62 is introduced to a stripper 56 that produces a stripper $C3^+$ stream 58 and a stripper $C2^-$ stream 60. The stripper $C3^+$ stream 58 includes $C3^+$ compounds, and the stripper 56 is operated at conditions that separate $C3^+$ compounds from CT compounds. The stripper $C3^+$ stream 58 includes a higher concentration of olefins than the saturated naphtha stream 30, and may include about 10 to about 70 weight percent olefins. The stripper $C2^-$ stream 60 includes $C2^-$ compounds with a higher concentration of olefins than the saturated stabilizer stream 32, and may include about 10 to about 70 weight percent of olefins.

The stripper 56 is part of a fractionation area 68, where the combined stream 62 is fractionated into various components in the fractionation area 68. The union 61 is coupled to the fractionation area 68, so the combined stream 62 produced at the union 61 flows to the fractionation area 68. The fractionation area 68 produces hydrocarbon streams with more narrow boiling ranges than that of the combined stream 62, where the produced hydrocarbon streams can be used as feedstocks for other processes, as fuels, or in other manners. The fractionation area 68 may include a wide variety of fractionators to separate the combined stream 62 into desired fractions, as understood by those skilled in the art. In an exemplary embodiment, the fractionation area 68 includes the stripper 56, a debutanizer 74, and a depropanizer 80, but the fractionation area 68 may include other fractionators or other arrangements of fractionators in various embodiments. In the illustrated exemplary embodiment, the stripper $C3^+$ stream 58 flows to the debutanizer 74. The debutanizer 74 is operated at conditions adequate to separate $C4^-$ compounds from $C5^+$ compounds. The debutanizer 74 produces a gasoline stream 76 including $C5^+$ compounds and a debutanizer effluent 78 primarily including C3 and C4 compounds, such as about 90 weight percent or more C3 and C4 compounds. The gasoline stream 76 may have a boiling range of about 35° C. to about 210° C. The debutanizer effluent 78 flows to the depropanizer 80, which is operated at conditions that separate C3 compounds from C4 compounds. The depropanizer 80 produces a propyl stream 82 and a butyl stream 84, where the propyl stream 82 primarily includes C3 compounds (about 90 weight percent or greater C3 compounds including paraffinic and olefinic compounds), and the butyl stream 84 primarily includes C4 compounds (about 90 weight percent or greater C4 compounds including paraffinic and olefinic compounds.) The propyl stream 82, the butyl stream 84, and other streams described herein may be further fractionated in some embodiments (not illustrated), such as to separate propene from propane in the propyl stream 82.

The stripper $C2^-$ stream 60 flows to a hydrocarbon absorber system 63 to recover residual C3 and heavier hydrocarbons. An absorber recovery stream 65 flows into the hydrocarbon absorber system 63 and flows past the stripper $C2^-$ stream 60 in a counter-current flow. The absorber recovery stream 65 exits the hydrocarbon absorber system 63, and includes C3 and heavier hydrocarbons that may have been entrained in the stripper $C2^-$ stream 60. The absorber recovery stream 65 may include naphtha, light cycle oil, or other heavier hydrocarbons that do not vaporize and exit the hydrocarbon absorber system 63 with the stripper $C2^-$ stream 60. The absorber recovery stream 65 may be further processed or used after passing through the hydrocarbon absorber system 63. The hydrocarbon absorber system 63 may include one, two, or more towers in various embodiments.

In an exemplary embodiment, the stripper $C2^-$ stream 60 exits the hydrocarbon absorber system 63 and flows to an optional amine absorber 64 to remove hydrogen sulfide and carbon dioxide that may be present in the stripper $C2^-$ stream 60. Hydrogen sulfide and carbon dioxide boil at or below the temperature of $C3^+$ compounds, so hydrogen sulfide and carbon dioxide are separated from the stripper $C3^+$ stream by the stripper 56. The amine absorber 64 is coupled to an amine recovery unit 66 to recover the amines for further hydrogen sulfide removal. The amines react with the hydrogen sulfide and carbon dioxide, and produce a rich amine stream 70. The rich amine stream 70 flows to the amine recovery unit 66, where the rich amine stream 70 is heated to separate the hydrogen sulfide from the amine solution. The hydrogen sulfide is removed (not illustrated), and the regenerated amine solution is returned to the amine absorber 64 in a lean amine stream 72. Many amines can be used in the amine absorber 64, including but not limited to diethanol amine, monoethanol amine, methyldiethanol amine, and diisopropanol amine. The amine absorber 64 produces a refinery fuel gas stream 88 primarily including $C2^-$ compounds, where the refinery fuel gas stream 88 is largely free of hydrogen sulfide. For example, the refinery fuel gas stream 88 may include about 50 parts per million hydrogen sulfide by volume.

The fractionation area 68 and the amine absorber 64 process the combined stream 62, so separate fractionation areas 68 and amine absorbers 64 are not required to separately process the saturated stabilizer stream 32 and the unsaturated stream 46. However, the relatively olefin rich unsaturated stream 46 is combined with the relatively olefin poor saturated stabilizer stream 32 in the resulting combined stream 62, so separate fractionated streams with different olefin concentrations are not available.

The amine absorber 64 and the fractionation area 68 can also be used for other process streams to further reduce process equipment duplication. Many process streams may be hydrotreated to remove sulfur compounds such as mercaptans and sulfides, as well as nitrogen compounds such as amines and oxygenates. The hydrotreating process produces hydrogen sulfide as a by-product, and may produce some smaller, more volatile hydrocarbons from larger, higher boiling compounds. These smaller, more volatile hydrocarbons and other gaseous components, such as hydrogen sulfide, are discharged in a fuel gas stream. The fuel gas stream(s) typically include C1 and C2 compounds, and may contain low concentrations of C3 and C4 compounds, as well as hydrogen sulfide. However, the composition of a fuel gas stream often varies from one source to another. Hydrogen sulfide is volatile, with an atmospheric boiling point of about −60° C., so hydrogen sulfide and other gaseous components are generally discharged from a hydrotreating process in the fuel gas stream. The fuel gas streams from a plurality of hydrotreating units can be added to the combined stream 62 and co-processed. The fuel gas streams can be added to the combined stream 62, or to the saturated stabilizer stream 32, the unsaturated stream 46, or other streams that flow into the combined stream 62 in various embodiments. Many of the fuel gas streams include hydrogen, and the hydrogen may be recovered and re-used (not illustrated) either before or after the fuel gas streams are added to the combined stream 62.

In an exemplary embodiment, a hydrocarbon stream is treated in a hydrotreater. Hydrotreating is a well-known process, and involves contacting the hydrocarbon stream and hydrogen gas with a hydrotreating catalyst at hydrotreating conditions. Exemplary hydrotreating conditions in a hydrotreater include a temperature of from about 290° C. to about 400° C. and a pressure of from about 20 to about 140 atmospheres. Oxygen reacts with the hydrogen gas to produce water, sulfur compounds produce hydrogen sulfide, and nitrogen compounds produce ammonia. In an exemplary embodiment, the hydrotreating catalyst includes a Group VI and/or Group VIII active metal component on a support, where the support may be a porous refractory oxide including, but not limited to, alumina, alumina-silica, silica, zeolites, titania, zirconia, boria, magnesia, and combinations thereof. Supports other than refractory oxides are also possible in various embodiments. In some embodiments, other metals are included in the hydrotreating catalyst in addition to or in place of the Group VI and/or Group VIII metals, such as cobalt, nickel, or other metals. For example, metals that may be used in the hydrotreating catalyst include molybdenum, ruthenium, cobalt, nickel, tungsten, and combinations thereof. The calcined metal oxide catalysts may be reacted with sulfur to produce a metal sulfide, such as by contact with a sulfur containing compound including but not limited to hydrogen sulfide, organo sulfur compounds or elemental sulfur.

There are several optional hydrotreating units illustrated, and additional hydrotreating units may be used. In an exemplary embodiment, the crude kerosene stream 18 enters a crude kerosene hydrotreater 92 and produces a crude kerosene hydrotreater fuel gas stream 94 and a hydrotreated crude kerosene stream 96. The crude kerosene hydrotreater fuel gas stream 94 and the other hydrotreater fuel gas streams are added to the combined stream 62, as mentioned above, and the hydrotreated crude kerosene stream 96 may be sold as a product, further processed, or otherwise used. In a similar manner, the crude diesel stream 20 is hydrotreated in a crude diesel hydrotreater 98 to produce a crude diesel hydrotreater fuel gas stream 100 and a hydrotreated crude diesel stream 102. The saturated naphtha stream 30 is hydrotreated in a saturated naphtha hydrotreater 104 to produce a saturated naphtha hydrotreater fuel gas stream 106 and a hydrotreated saturated naphtha stream 108. The FCC diesel stream 48 is hydrotreated in an FCC diesel hydrotreater 116 to produce an FCC diesel hydrotreater fuel gas stream 118 and a hydrotreated FCC diesel stream 120. The crude diesel hydrotreater fuel gas stream 100, the saturated naphtha hydrotreater fuel gas stream 106, and the FCC diesel hydrotreater fuel gas stream 118 may be added to the combined stream 62, either directly or indirectly, such that many fuel gas streams can be co-processed. The hydrotreated crude diesel stream 102, the hydrotreated saturated naphtha stream 108, the hydrotreated FCC diesel stream 120, and other hydrotreated streams may be sold as products, further processed or blended, or otherwise used in various embodiments. Other hydrocarbon streams may be hydrotreated in a similar manner (not illustrated), and the resulting fuel gas stream(s) can be added to the combined stream 62.

Other process streams may be included in the combined stream 62 in various embodiments. In one example described above, an unsaturated stream may be produced by a coker (not illustrated) in place of, or in addition to, the FCC unit 40. The crude distillation unit 14 may include a vacuum tower, and thermal processing of the vacuum tower bottoms (not illustrated) can produce another saturated stream that may be combined with the combined stream 62.

A hydrocracking unit 130 is another example of an operation that may produce a saturated stream that is included in the combined stream 62. In an exemplary embodiment, a hydrocracker feedstock 132 is introduced to the hydrocracking unit 130. The hydrocracker feedstock 132 may be heavy cycle oil, atmospheric and/or vacuum gas oil, delayed coking gas oil, or other compounds in various embodiments. The hydrocracker feedstock 132 is contacted with a hydrocracking catalyst (not individually illustrated) in the presence of hydrogen at hydrocracking conditions to crack hydrocarbons into smaller hydrocarbons. Exemplary hydrocracking catalysts include zeolitic compounds with a metal from Group VIB and/or VIII, and optionally one or more metals from group VIIA, VIIB, phosphorous, boron, and silicon. Hydrocracking catalysts are known to those skilled in the art. Exemplary reaction conditions include temperatures of about 260° C. to about 430° C., and pressures of about 35 kPa to about 20,000 kPa. Olefinic or aromatic compounds that may be formed in the hydrocracking unit 130 may be hydrogenated to form paraffinic compounds, which can then be separated by fractionation within the hydrocracking unit 130 to produce one or more hydrocracker product streams 134 and a hydrocracker saturated stream 136 including $C10^{-}$ compounds. The hydrocracker product stream 134 may be used as a fuel, an intermediate product, further processed or otherwise used. The hydrocracker saturated stream 136 may be added to the combined stream 62 in place of the saturated stabilizer stream 32 from the crude distillation unit 14 in some embodiments, or in addition to the saturated stabilizer stream 32. In other embodiments, no hydrocracker saturated stream 136 is included in the combined stream 62. Many refining processes are known to produce various saturated streams or unsaturated streams, and different saturated and unsaturated streams may be combined and then fractionated to reduce the number of fractionation areas 68 required in an oil refining apparatus.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the application in any way. Rather, the foregoing detailed description will provide those skilled in the art with a convenient road map for implementing one or more embodiments, it being understood that various changes may be made in the function and arrangement of elements described in an exemplary embodiment without departing from the scope, as set forth in the appended claims.

The invention claimed is:

1. A method of producing hydrocarbons comprising the steps of:

fractionating a crude oil feedstock to produce a crude saturated stream and a residual stream;

cracking the residual stream in a cracking device to produce an unsaturated stream;

combining the crude saturated stream with the unsaturated stream to produce a combined stream; and fractionating the combined stream to produce a refinery fuel gas stream.

2. The method of claim 1 wherein fractionating the combined stream comprises producing a stripper C2− stream, the method further comprising:

removing hydrogen sulfide from the stripper C2− stream to produce the refinery fuel gas stream.

3. The method of claim 1 wherein cracking the residual stream comprises cracking the residual stream in a fluid catalytic cracking unit.

4. The method of claim 1 wherein fractionating the combined stream comprises producing a gasoline stream.

5. The method of claim 1 wherein fractionating the combined stream comprises producing a butyl stream.

6. The method of claim 1 wherein fractionating the combined stream comprises producing a propyl stream.

7. The method of claim 1 wherein fractionating the combined stream comprises producing the refinery fuel gas stream, a gasoline stream, a butyl stream, and a propyl stream.

8. The method of claim 1 where fractionating the crude oil feedstock comprises producing a crude diesel stream, the method further comprising:

hydrotreating the crude diesel stream to produce a crude diesel hydrotreater fuel gas stream; and combining the crude diesel hydrotreater fuel gas stream with the combined stream prior to fractionating the combined stream.

9. The method of claim 1 further comprising:

combining a plurality of hydrotreating fuel gas streams with the combined stream prior to fractionating the combined stream.

10. The method of claim 1 further comprising:

fractionating the crude saturated stream to produce a saturated naphtha stream and a saturated stabilizer stream; and wherein combining the crude saturated stream with the unsaturated stream comprises combining the saturated stabilizer stream with the unsaturated stream.

11. The method of claim 1 further comprising:

combining a hydrocracker saturated stream with the combined stream prior to fractionating the combined stream.

12. A method of producing hydrocarbons comprising the steps of:

hydrocracking a hydrocracker feedstock to produce a hydrocracker saturated stream and a hydrocracker product stream;

cracking a residual stream in a cracking device to produce an unsaturated stream;

combining the hydrocracker saturated stream with the unsaturated stream to produce a combined stream; and fractionating the combined stream to produce a gasoline stream.

13. The method of claim 12 wherein cracking the residual stream in the cracking device comprises cracking the residual stream in a fluid catalytic cracking unit.

14. The method of claim 13 wherein cracking the residual stream comprises producing a fluid catalytic cracking diesel stream, the method further comprising:

hydrotreating the fluid catalytic cracking diesel stream to produce a fluid catalytic cracker diesel hydrotreater fuel gas stream; and combining the fluid catalytic cracker diesel hydrotreater fuel gas stream with the combined stream prior to fractionating the combined stream.

15. The method of claim 12 wherein fractionating the combined stream comprises producing a refinery fuel gas stream.

16. The method of claim 15 wherein fractionating the combined stream comprises producing a stripper C2− stream, the method further comprising:

removing hydrogen sulfide from the stripper C2− stream in an amine absorber to produce the refinery fuel gas stream.

17. The method of claim 12 wherein fractionating the combined stream comprises producing the gasoline stream, a refinery fuel gas stream, a butyl stream, and a propyl stream.

18. The method of claim 12 further comprising:

combining a plurality of hydrotreater fuel gas streams with the combined stream prior to fractionating the combined stream.

19. The method of claim 12 further comprising:

combining a crude saturated stream with the combined stream prior to fractionating the combined stream.

20. An oil refining apparatus comprising:

a crude distillation unit comprising a crude receiver;

a saturated compressor fluidly coupled to the crude receiver;

a fluid catalytic cracking unit fluidly coupled to the crude distillation unit a fluid catalytic cracking compressor fluidly coupled to the fluid catalytic cracking unit;

a union coupled to the fluid catalytic cracking compressor and the saturated compressor; and a fractionation area fluidly coupled to the union.

* * * * *